US008911175B2

(12) United States Patent
Koerner

(10) Patent No.: US 8,911,175 B2
(45) Date of Patent: Dec. 16, 2014

(54) DRAINAGE MANAGEMENT SYSTEM AND METHOD

(76) Inventor: Robert H. Koerner, Coal City, IL (US)

( * ) Notice: Subject to any disclaimer, the term of this patent is extended or adjusted under 35 U.S.C. 154(b) by 138 days.

(21) Appl. No.: 13/599,567

(22) Filed: Aug. 30, 2012

(65) Prior Publication Data

US 2013/0058721 A1 Mar. 7, 2013

Related U.S. Application Data

(60) Provisional application No. 61/530,953, filed on Sep. 3, 2011.

(51) Int. Cl.
*E02B 13/00* (2006.01)
*E03F 3/04* (2006.01)
*E01C 11/22* (2006.01)

(52) U.S. Cl.
CPC ..... *E03F 3/046* (2013.01); *E01C 11/227* (2013.01); *E02B 13/00* (2013.01)
USPC ..... 405/36; 405/39; 405/80; 405/119

(58) Field of Classification Search
CPC ..... E03F 3/046; E01C 11/227; E02B 13/00
USPC ..... 405/36, 42, 118–123, 39, 80; 52/11
See application file for complete search history.

(56) References Cited

U.S. PATENT DOCUMENTS 5,437,138 A * 8/1995 Tuohey et al. ..... 52/741.1
6,612,780 B2 * 9/2003 Dahowski et al. ..... 405/118

* cited by examiner

*Primary Examiner* — Benjamin Fiorello
*Assistant Examiner* — Kyle Armstrong
(74) *Attorney, Agent, or Firm* — Carlos R. Villamar; The Villamar Firm PLLC

(57) ABSTRACT

Systems and methods for drainage management, including a pipe that is cut along a longitudinal section thereof; and a pipe block having a curved section corresponding to a diameter of the cut pipe and including supporting legs. The curved section of the pipe block is configured to support the cut pipe.

8 Claims, 6 Drawing Sheets

DRAINAGE MANAGEMENT SYSTEM AND METHOD

CROSS REFERENCE TO RELATED APPLICATIONS

The present invention claims benefit of priority to U.S. Provisional Patent Application Ser. No. 61/530,953 of Robert H. KOERNER, entitled "DRAINAGE MANAGEMENT SYSTEM AND METHOD," filed on Sep. 3, 2011, the entire disclosure of which is hereby incorporated by reference herein.

BACKGROUND OF THE INVENTION

1. Field of the Invention

The present invention generally relates to systems and methods for drainage management, and can include a drain management system employing a weighted object devised for the purpose of positioning and holding down trough structures used for the conveyance of liquids, such as storm water drainage, irrigation distribution, a diversionary device when positioned in rotated positions, and the like 2. Discussion of the Background In recent years, solutions to combat erosion and drainage typically employ closed piping, prefabricated continual or cast in place concrete lining systems of various shapes and configurations, construction of liners made from materials, such as stones or graded aggregates. However, such drainage management systems and methods typically are not cost effective, are not reusable, and lack ease of maintenance. Therefore, there is a need for a method and system for drainage management that addresses the above and other problems with current methods and systems.

SUMMARY OF THE INVENTION

The above and other problems are addressed by exemplary embodiments of the present invention, which advantageously provide drainage management systems and methods that relate to the inexpensive lining of an open liquid conveyance system and/or diversion of fluids. The drainage management systems and methods of the present invention can be used to hold down an open conveyance system, and not necessarily a closed system.

Accordingly, aspects of the present invention relate to a system and method for drainage management, including a pipe that is cut along a longitudinal section thereof; and a pipe block having a curved section corresponding to a diameter of the cut pipe and including supporting legs. The curved section of the pipe block is configured to support the cut pipe.

The system and method can include an under pipe barrier section located along the drainage management system and configured for stopping flowing water on an outside of the drainage management system for erosion control.

The system and method can include an end pipe bather section located at an end the drainage management system and configured for disallowing water passage to an outside of the drainage management system to avoid erosion.

The system and method can include an end bather closing block section located within the end pipe barrier section and configured for closing off an end of the drainage management system.

Still other aspects, features, and advantages of the present invention are readily apparent from the following detailed description, simply by illustrating a number of illustrative embodiments and implementations, including the best mode contemplated for carrying out the present invention. The present invention is also capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The embodiments of the present invention are illustrated by way of example, and not by way of limitation, in the figures of the accompanying drawings and in which like reference numerals refer to similar elements and in which.

DETAILED DESCRIPTION OF THE INVENTION

Figure 1:
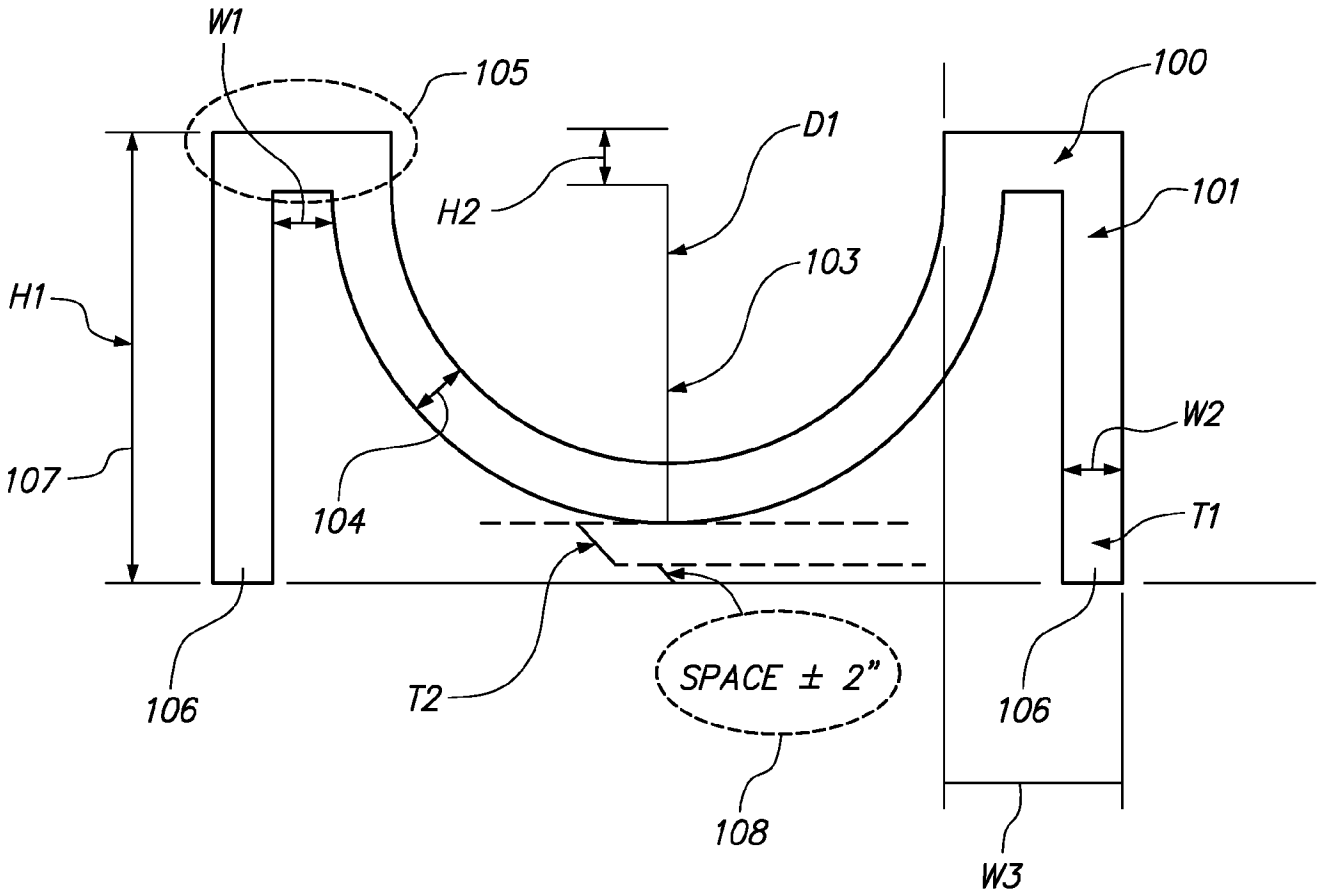
FIGS. 1-8 are used to describe drainage management systems and methods, according to the present invention.

The present invention generally relates to systems and methods for drainage management, and can include a drain management system employing a weighted object devised for the purpose of positioning and holding down trough structures used for the conveyance of liquids, such as storm water drainage, irrigation distribution, a diversionary device when positioned in rotated positions, and the like. Advantageously, the drain management system can be used for the construction of an open drainage way by use of inexpensive and readily available and various sized circular plastic or other suitable material pipes of length cut into determined partial circles longitudinally and positioned and held down by weighted objects specifically formed and shaped for the mechanical purposes necessary to perform the intended use. Of equal value is the effect to environmental issues of erosion, sedimentation, enhancing water quality as well as a means of controlling pollution issues, and the like.

The earth is subject to natural and manmade flow of water that obeys the laws of gravity and in the process has developed water courses through all forms of materials. Civilization in developed locations improve on collecting and directing water flows of different sources (e.g., mostly rain) to allow a controlled system to aid in society living a never ending improvement on living conditions for health and welfare. Most collection and conveyance systems end into open area referred to commonly as ditches or waterways, natural and manmade. These areas left unattended in the majority of situations create erosion in quantities and rates depending on the soils the water comes into contact.

Solutions to erosion are closed piping, prefabricated continual or cast in place concrete lining systems of various shapes and configurations, construction of liners made from materials, such as stones or graded aggregates. By contrast, the drainage management systems and methods of the present invention provide for cost effectiveness, reusability, and ease of maintenance, and can be used to stop or prevent erosion, while at the same time controlling water flow energy, removing sedimentation from flowing water, and the like.

To counteract erosion that is considered destructive to the health and welfare of the people in many forms, laws as well as common sense approaches are applied to the drainage systems to prevent erosion. An example of a devised system is the Smart Ditch System (see, e.g., the World Wide Web at smartditchsystem.com). Such a system is a specifically manufactured plastic conveyance system that is positioned and held down with mechanical anchor devices made specifically for the system. However, what is not accomplished by such a system is use of materials already commonly available worldwide, nor does the system allow for simple and fast installation, nor the ability to allow replacement or relocating of the system without any problem or loss of the original value.

Therefore, there is a need for a method and system for drainage management that addresses the above and other problems with current methods and systems. The above and other needs are addressed by embodiments of the present invention, which provide drainage management systems and methods of the present invention that need not replicate mat type systems of any suitable type for bank type erosion from running water or wave/tidal action of moving water. In addition, the drainage management systems and methods of the present invention need not be employed for holding down items in water, such as pipelines or cables of any suitable type. Rather, the drainage management systems and methods of the present invention relate to the inexpensive lining of an open liquid conveyance system and/or diversion of fluids. The drainage management systems and methods of the present invention can be used to hold down an open conveyance system, and not necessarily a closed system.

Figure 2:
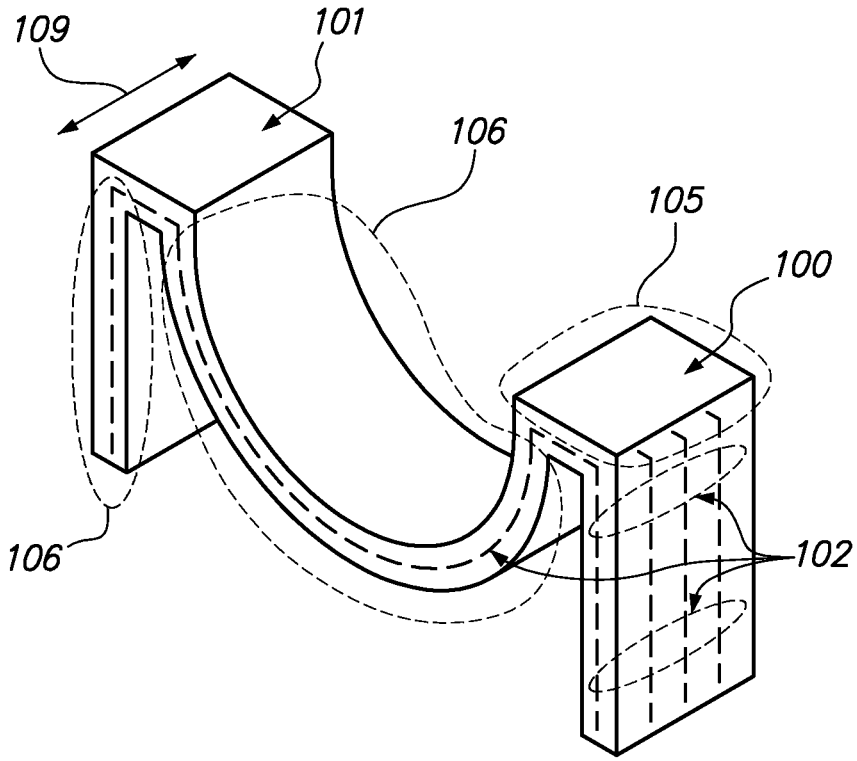
Figure 3:
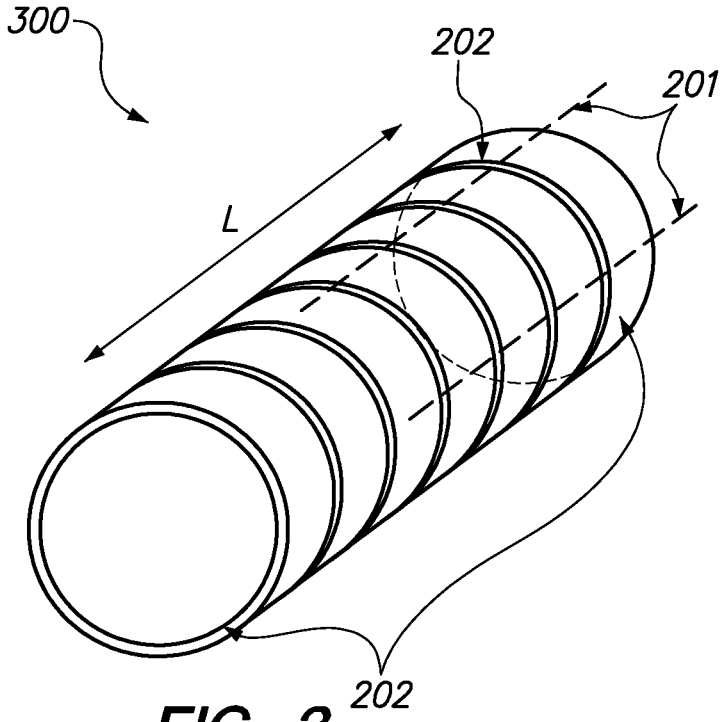

Accordingly, in illustrative aspects, there are provided systems, and methods for drainage management including at least one of a cut pipe as shown or described in FIG. 3; and a pipe block as shown or described in FIG. 1, 2 or 4. The systems and methods further comprising an under pipe bather section as shown or described in FIG. 5, an end pipe barrier section as shown or described in FIG. 6, and an end bather closing block section as shown or described in FIG. 7.

Advantageously, the drainage management systems and methods of the present invention can employ use of common materials in a manner to lower required expertise, lower investments for production, lower material costs, lower material shipping costs, lower installation costs, lower level of preciseness needed for installation, lower maintenance costs, lower replacement costs, create a 100% recyclable green product, stop or prevent soil erosion, stop or prevent bank sloughing, create sedimentation pooling, oxygenate water by turbulence, reduce water flow energy by turbulence, and the like.

In FIGS. 1-8, a pipe ditch liner 200 (e.g., made of plastic or any other suitable material, etc.) shown in FIG. 3, can be a commonly manufactured solid, ribbed, or rib lined plastic or other material drainage pipe in any suitable diameter of various lengths and that are cut in half, in third, or any suitable lesser radian of a circle of the pipe, etc., as needed, longitudinally as shown with cut lines 201 to provide a liquid flow area of approximately one half, one third, or any suitable lesser radian of the circle of the pipe, etc., being used. Such cut pipe can be performed at and obtained from the pipe factory, which then allows lower shipping costs due to the bulk dimension of a pipe being reduced due to use of space not determined by the full circumference of the pipe. Existing manufactured pipes 200 can also, with minimal time and tools, be cut at the installation site, if necessary.

Jointing of continuous pieces can be performed as the pipe is manufactured with an "over under" lapping as an industry standard shown at 202 and commonly known as "bell and spigot" or "male and female connector" (e.g., manufactured or easily cut in the field for custom lengths of pipe). Existing systems of "sealing the joint" as shown at 202 can be performed at the user's discretion for the effectiveness of the seal at the joint 202.

Placement of such a piping segment 200 allows for liberal line/grade or bedding conditions. The half pipe 200 stops the bottom erosion of soils keeping the water from saturating earth on the bottom or sides of a natural or constructed soil system. The pipe 200 can be held in place by pipe blocks of FIGS. 1-2 and stops the bottom side slopes from sloughing into the flow area due to the solid side wall structure of the pipe 200 to counteract tangential forces. The pipe 200 holds back the side walls and is kept in shape and from moving by the forces induced by the pipe blocks of FIGS. 1-2.

In FIGS. 1-2, concrete blocks or pipe blocks 100 can be suitably shaped and for example, made of reinforced concrete, and the like. The material can be concrete 101 for the its strength, longevity, and weight along with reinforcement 102 to unify the block 100 during manufacturing, transportation, and installation, creating an engineered product adhering to design structural codes and standards for use and safety. The profile shape of the block 100 can include a radius 103 that within a suitable tolerance is the same as the inside diameter of the pipe 200 associated therewith, so as to conform to the general inside diameter of the pipe 200 size being used. Such tolerance provides a frictional fit due to the mass of the block 100 as the block 100 rests upon the pipe 200 at predetermined suitable intervals, providing a great reduction of seepage of water between the block 100 and the pipe 200, and provides the forces necessary to mechanically lock joints by using gravity due to the mass of the block 100 gravity force and the opposite or opposing force of the material under the pipe 200.

The thickness of the radius concrete 104 induces turbulence as fluids flow over them and between the installed blocks 100 and the interior of the pipe 200 surface intentionally to reduce water flow energy with the added result of the settlement of sediment within the system to be cleaned out periodically, and which stops sedimentation from flowing down stream to natural waters and provides the advantage of the turbulence oxygenating the water to aid in the bio degradation of organics in the water.

A top portion 105 connects the internal radius structural element to the external two legs 106, which sit outside of the piping 200 being used. The design is such to allow for lifting of the block 100 with various rigging methods and to allow variability for thickness of the wall of the pipe 200 manufactured by various styles or designs. The two legs 106 are vertical and include a height 107 of approximate determination related to the radius 103 and thickness 104 of the pipe 200 used, plus an increased minor addition 108 of approximately 2 inches to allow the legs 106 to settle into the earth a minimal amount before the exterior of the pipe 200 being held down contacts graded base material and undergoes the process of natural settlement of the legs 106 alone as time goes by. This allows the piping system to balance the distribution of static and dynamic, natural and induced forces, between the bottom of the exterior pipe 200 and the legs 106 after legs 106 are initially settled. The lengthening of the legs 106 to the length 107 provide an initial settlement of the block 100 into the soils to prevent the tangential forces shifting of the block 100 after placement and during the exterior backfilling of the piping system against exterior walls and blocks.

As shown in FIG. 1, the height by H1 relates to the pipe diameter and concrete thickness. The width W1 is the pipe thickness (e.g., 2 inches or more). The inside pipe diameter is shown by D1. The height H2 relates to the concrete thickness. The width W2 can be around a minimum of 5 inches. The legs 106 are tapered as shown by T1 so as to be wider at the bottom for assisting form release, and the like. The pipe thickness T2 can be variable, as needed. The width W3 can relate to the pipe thickness, for providing additional space, and based on the concrete thickness.

In further illustrative embodiments, the profile of the section 105 need not be square shaped at the internal and external edges or corners, and the like. For example, the transition direction changes at the section 105 can have a curved shape (e.g., as in FIG. 4D) or any other suitable geometrical shape, and the like, for manufacturing, structural, or esthetic, and the like, purposes, as will be appreciated by those of ordinary skill in the relevant art(s).

The depth dimension 109 (e.g., or side width of the block 100 sitting longitudinal on the half pipe 200) of the block 100 can be a calculated dimension for the calculated weight of the novel block 100 for the following reasons. The block 100 induces the natural force of gravity to counteract the natural lifting force of buoyancy. The buoyancy of a piping system used in areas with a fluid nature can be subject to the lowering of frictional soil values and the natural laws of engineered displacement of fluids. The block 100 induces the natural forces of gravity to counteract the natural lifting force of frost. Since some installation of the system can include areas subject to frost of various depths and may not be of a diameter radius depth to be below the established frost line, the block 100 can use the element of mass to reduce this frost force. The block 100 mass is also a factor to determine spacing of the blocks 100 set on the continually installed pipe 200. A cost analysis of production, handling, transporting, and installation can determine a suitable spacing, center to center, for example, of 10 lineal feet, and the like. However, alternate sizing with a relationship to mass and material type and joint spacing can be altered to fit specific conditions including the complete lining of the plastic pipe 200. This alternate use lends itself to the upward extension of the legs to produce a "wall" effect above the original system technology cast as part of the block unit. Advantageously, the dimensional depth in conjunction with concrete block 100 thickness aides in the spanning of the joints held in place by the mass creating frictional values between base material to plastic, plastic to plastic, plastic to concrete, while compressing the joint between the base material and the block 100.

As shown in FIG. 2, the block 200 can employ the reinforcements 102 that are cage bar centered as shown by CBC, and which can be based on industry standards, codes, and the like, as needed. The reinforcements 102 can include variable cross pieces for reinforcement, cage stabilization, lift hook extensions, and the like.

As shown in FIG. 3, the length L can vary, as needed, and the cut pipe 300 can be made from a common ribbed plastic pipe, and the like. The cut pipe 300 can include bell and spigot lap joint ends 202.

In FIG. 4, alternate variations of the blocks 100 and potential uses of the system are shown. The pipe blocks 100 can be manufactured in profiles to range from vertical 110 to horizontal 111 installations. The pipe blocks 100 also can be manufactured to radian 112 sections for wide but shallow uses. The blocks 100 can be manufactured to allow an angled (e.g., any suitable angle between 110 to 111) installation of the pipe 200 for desired installation. The blocks 100 can be manufactured to allow an angled installation of the pipe to aid in wave or tide water from fully extending into a shore line. This use has the potential of a fast and temporary installation to hinder the travel of pollutants floating on water from intrusion into inland areas. Short installations in midstream are possibilities for material control for the potential of redirecting flow to stop downstream bank erosion (e.g., one piece installed and then covered with big rock unifies the rocks so water acts against the unit of rocks instead of each individual rock).

Figure 4A:
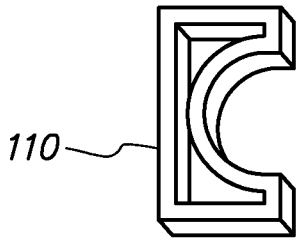
Figure 4B:
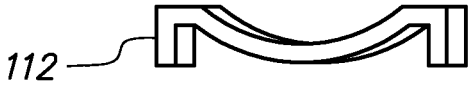
Figure 4C:
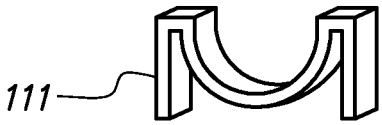
Figure 4D:
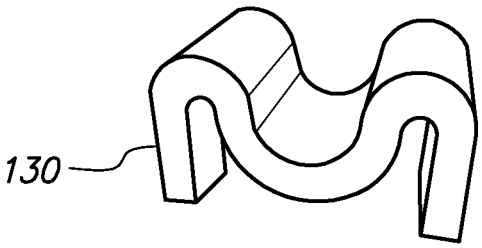

As shown in FIG. 4A, a plastic pipe can slide into the pipe block 110 for vertical position of pipe section, as shown by S. In FIG. 4B, the pipe block 112 can be configured for a radian section, wide but shallow installation. In FIG. 4C, the pipe block 111 can be configured for normal applications. In FIG. 4D, the pipe block 130 can be configured with curved shapes.

Figure 5:
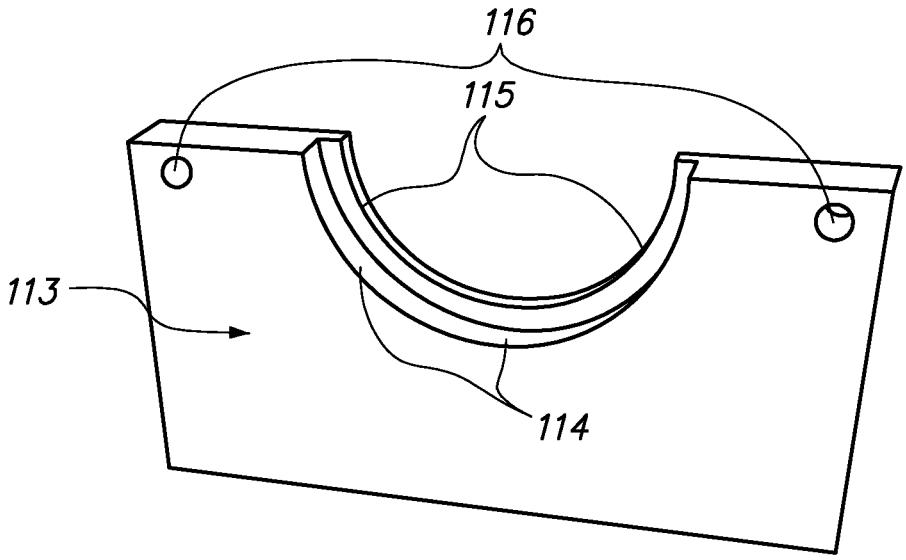

In FIG. 5, an under pipe barrier section 113 is shown. The precast concrete section 113 can be of a considerable size larger than the pipe 200 section for the purpose of stopping flowing water on the outside of the pipe block system to aid in erosion control, line, and grade of pipe 200 being installed in conjunction with normal installation of pipe blocks 100. The pipe barrier section 113 can be employed at the beginning and end sections of the system and/or wherever deemed necessary. The elements of the barrier 113 include a reinforced slab of concrete with lifting holes 116. A partial circumference relating to the exterior diameter of the ribbed exterior wall of the pipe being used is molded at 114. A novel portion of the barrier 113 is the integral formed lip 115 that is sized to fit between the plastic pipe 200 ribs. The weight of the pipe block above completes the mechanical connection that virtually prevents water flow passing along the outside of the pipe block system to stop erosion and resulting displacement or settlement of the surround backfill. This is also a benefit to tangential above grade connections for surface drainage with our without a main tributary system. Formed in place, the lifting holes 116 add convenience to the barrier 113.

Figure 6:
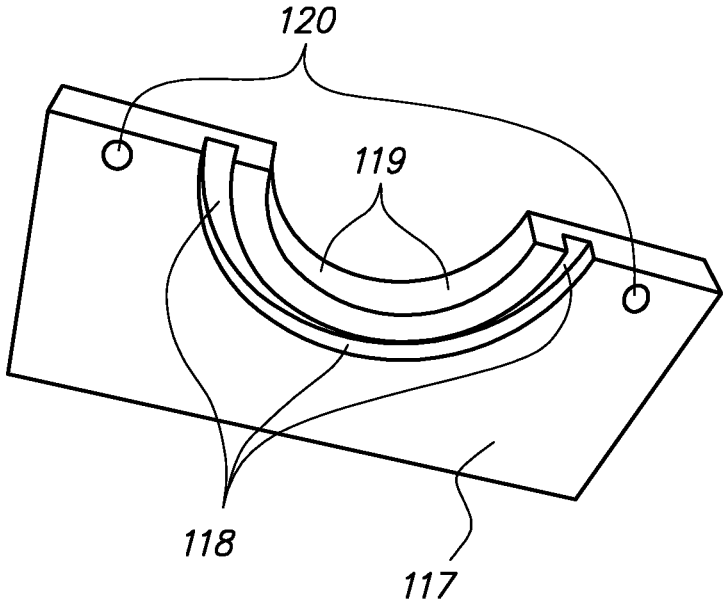

In FIG. 6, an end pipe barrier section 117 is shown. The barrier 117 is best used at the upstream end of a pipe system, but can also be used at the downstream end piece, if caution of seepage is addressed with sealant materials. The purpose of the barrier 117 is to disallow water passage to the outside of the pipe system to avoid erosion or the costly installation of onsite cast in place methods. The elements are novel in that a simple placement of the pipe 200 used is fitted into the cast in place groove 118 for preventing the pipe 200 from horizontal and vertical motion up or down or sideways. In conjunction with the placement of a pipe block 100 adjacent to the end barrier 117, the weight of the designed block 117 prevents lifting from buoyancy or frost lift while using the extent of bottom surface area of the pipe block 100 and barrier 113 counteracting settlement. The overhang lip 119 replicates the profile of the interior shape in a normal pipe block 104 allowing for continuity of the system. Lifting holes 120 are of value for lifting of the barrier 117 for manufacturing, transportation, and installation as well as removal for maintenance or re-use.

Figure 7:
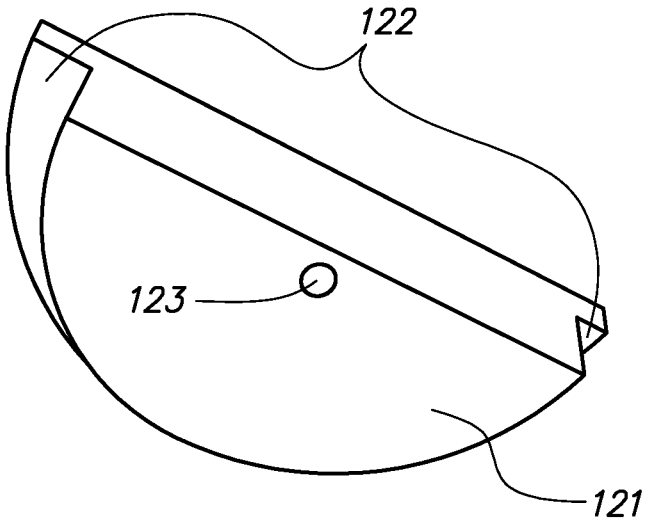

In FIG. 7, an end barrier closing block section 121 is shown. The closing block 121 is manufactured to sit within the end pipe barrier 117 to close off the entire end at the beginning or end of a pipe block system. Placement at of the closing block 121 on the inside or outside of the end pipe barrier 117 is determined by the purpose needed and soil conditions and the feeding method into the pipe block system. The block 121 benefits from dimensional stability and weight to remain in place. The extended lip 122 aligns against the parallel surface of the end pipe barrier 117 and prevents tangential movement in horizontal directions due to soils positioned against the backside on upstream installation, or the additional connection of drilled in place drop pins for downstream applications or as additional locking of the block to the end barrier. As with other components, a lifting hole 123 provides for safe and easy movement of the component.

Figure 8:
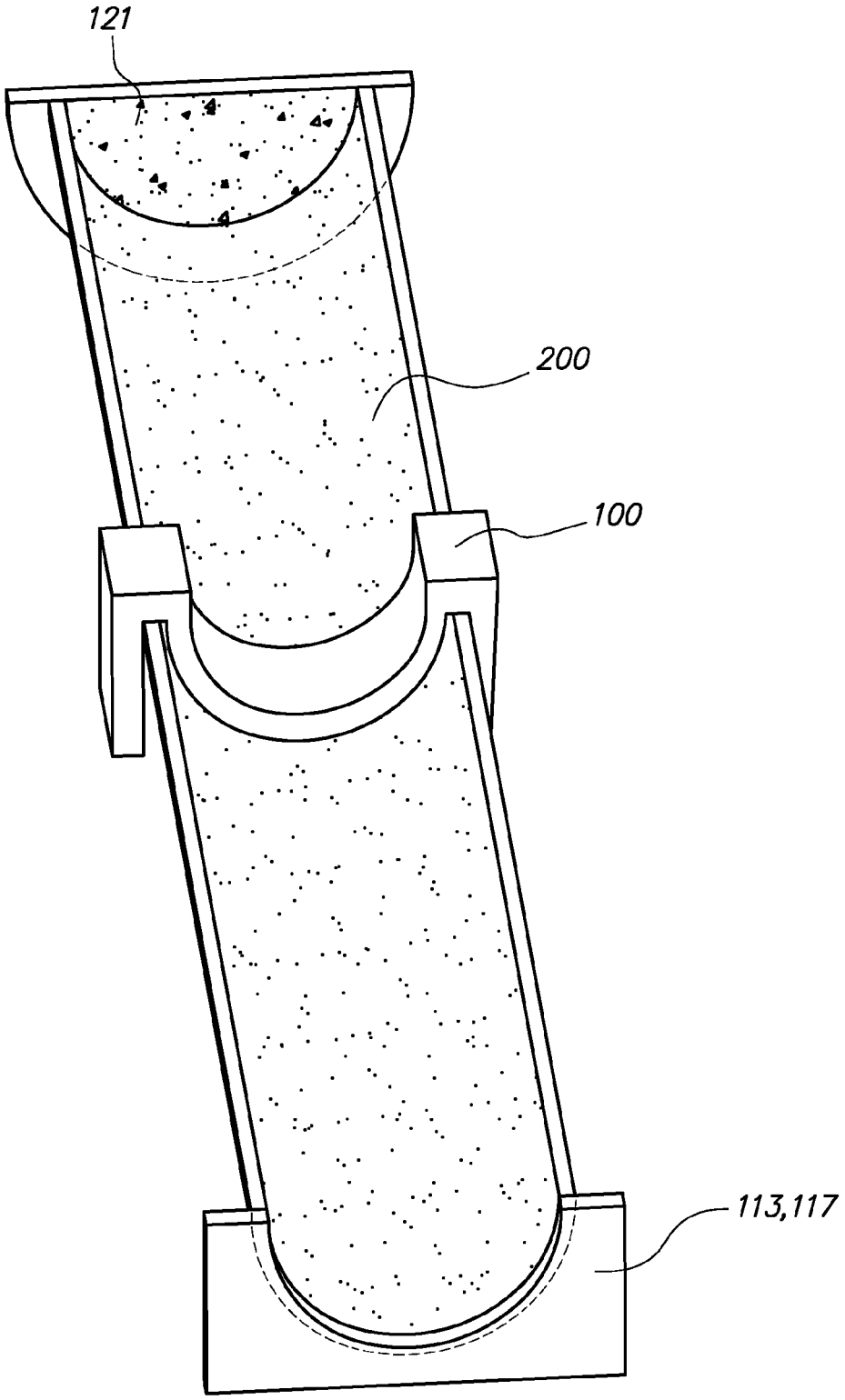

In FIG. 8, the drainage management systems is shown, for example, including the pipe block 100, the cut pipe 200, the end pipe barrier 113 or 117 and the closing block 121 that fits on the end pipe barrier 117 (not shown). Thus, the drainage management systems and methods of the present invention can include the reinforced concrete blocks of FIGS. 1-2 and 4-8 and the pipes 200 of FIG. 3 shaped to line ditches for controlling movement of channeled water, tides, or waves from bodies of water. The application of the drainage management systems and methods counteract the natural forces of buoyancy and frost lift, stop erosion of bottom soils and stop bank sloughing due to soil saturations at the base flow line and vertical erosion undermining side banks. In the common installation of lining an open ditch, the pipe 200 of FIG. 3 lines a minimal lower portion of an open natural conveyance system for water or fluid drainage and is kept on line and grade by the mass of the concrete blocks of FIGS. 1-2 and 4-8 counteracting buoyancy and frost lift. The variations for vertical, angled, or normal installations are variable in all parameters of dimensions or site conditions and for the purpose intended. The profile of pipe 200 of FIG. 3 can be of any suitable radian degree so as to meld with the shape of the pipe blocks of FIGS. 1-2 and 4-8.

Advantageously, the drainage management systems and methods of the present invention employ common manufactured materials in a different form, require minimal cost of manufacturing and handling, provide a system not in existence of such simplicity and cost through all phases of production, transportation, installation, provide a product reducing long term maintenance and repair, provide a product completely recyclable or reusable or relocated, stop ditch bottom erosion, stop side bank sloughing, clean sediment out of water, oxygenate water, reduce water flow energy with minimal capacity rate change, provide a low tech production and installation product easily learned in the field, are usable as a method for shoreline disaster pollution, are usable as a stream or river side bank erosion possibilities, are usable as an in stream diversion to avoid downstream bank erosion, and are usable as an irrigation distribution system, and the like.

Although the systems and methods of FIGS. 1-8 are described in terms of being employed for drainage management, and the like, the systems and methods of FIGS. 1-8 can be employed for other types of suitable applications where water flow and erosion management are desired, as will be appreciated by those of ordinary skill in the relevant art(s).

While the present inventions have been described in connection with a number of illustrative embodiments, and implementations, the present inventions are not so limited, but rather cover various modifications, and equivalent arrangements, which fall within the purview of the appended claims.

What is claimed is:

1. A system for surface water drainage management, comprising:

a pipe that is cut along a longitudinal section thereof and configured to be installed in a trench in ground; and a concrete pipe block having a curved section corresponding to a diameter of the cut pipe and including supporting legs and positioned over top of the cut pipe and configured to hold the cut pipe down and keep the cut pipe open;

wherein the curved section of the pipe block is configured to support the cut pipe, and a top surface of the concrete pipe block constitutes part of a surface water flow path of the surface water drainage management system.

2. The system of claim 1, further comprising an under pipe barrier section located underneath the cut pipe and configured for supporting the cut pipe from underneath, and configured to fit a bottom contour of the cut pipe.

3. The system of claim 1, further comprising an end pipe barrier section located at an end of the cut pipe and configured for disallowing water passage to an outside of the end of the cut pipe, and configured to fit an edge contour of the cut pipe.

4. The system of claim 3, further comprising an end barrier closing block section located within the end pipe barrier section and configured for closing off an end of the cut pipe.

5. A method for surface water drainage management, comprising:

providing a pipe that is cut along a longitudinal section thereof and configured to be installed in a trench in ground; and providing a concrete pipe block having a curved section corresponding to a diameter of the cut pipe and including supporting legs and positioned over top of the cut pipe and configured to hold the cut pipe down and keep the cut pipe open;

wherein the curved section of the pipe block is configured to support the cut pipe, and a top surface of the concrete pipe block constitutes part of a surface water flow path of the surface water drainage management method.

6. The method of claim 5, further comprising providing an under pipe barrier section located underneath the cut pipe and configured for supporting the cut pipe from underneath, and configured to fit a bottom contour of the cut pipe.

7. The method of claim 5, further comprising providing an end pipe barrier section located at an end of the cut pipe and configured for disallowing water passage to an outside of the end of the cut pipe, and configured to fit an edge contour of the cut pipe.

8. The method of claim 7, further comprising providing an end barrier closing block section located within the end pipe barrier section and configured for closing off an end of the cut pipe.

* * * * *